US006728987B1

(12) United States Patent
Hinman

(10) Patent No.: US 6,728,987 B1
(45) Date of Patent: May 4, 2004

(54) METHOD OF ADJUSTING THE VERTICAL PROFILE OF A CABLE SUPPORTED BRIDGE

(75) Inventor: John David Hinman, Boise, ID (US)

(73) Assignee: CH2M Hill, Inc., Englewood, CO (US)

( * ) Notice: Subject to any disclaimer, the term of this patent is extended or adjusted under 35 U.S.C. 154(b) by 0 days.

(21) Appl. No.: 10/128,209

(22) Filed: Apr. 23, 2002

(51) Int. Cl.[7] ..... E01D 11/00; E01D 19/16
(52) U.S. Cl. ..... 14/77.1; 14/22; 14/23
(58) Field of Search ..... 14/2, 2.4, 18, 19, 14/20, 21, 22, 23, 77.1, 78

(56) References Cited

U.S. PATENT DOCUMENTS

| | | | | |
|---|---|---|---|---|
| 903,630 A | | 11/1908 | Bridge | |
| 951,874 A | | 3/1910 | Wood | |
| 1,714,187 A | | 5/1929 | Pacy | |
| 1,801,206 A | | 4/1931 | Mott | |
| 2,217,593 A | | 10/1940 | London | |
| 2,368,907 A | | 2/1945 | Whitnall | |
| 2,433,878 A | | 1/1948 | Wolfard | |
| 2,634,122 A | | 4/1953 | Wolfard | |
| 3,114,161 A | | 12/1963 | Colombot | |
| 3,421,167 A | | 1/1969 | Kawada | |
| 3,471,881 A | | 10/1969 | Kawada | |
| 3,864,776 A | * | 2/1975 | Hedefine et al. | 14/21 |
| 4,069,765 A | | 1/1978 | Muller | |
| 4,208,969 A | | 6/1980 | Baltensperger | |
| 4,457,035 A | | 7/1984 | Habegger et al. | |
| 5,208,932 A | * | 5/1993 | Muller | 14/21 |
| 5,850,652 A | | 12/1998 | Yamamura et al. | |

* cited by examiner

*Primary Examiner*—Robert E. Pezzuto
*Assistant Examiner*—Alexandra K. Pechhold
(74) *Attorney, Agent, or Firm*—Swanson & Bratschun, LLC

(57) ABSTRACT

A method of modifying the vertical profile of a cable supported bridge. The method consists of sequentially adjusting a lower end of a series of supporting cables downward relative to the bridge superstructure and sequentially adjusting an attachment structure associated with the lower end of each cable to maintain the distance each cable has been adjusted. The adjustments preferably proceeds according to a pre-specified plan known as an adjustment sequence. The preparation of an adjustment sequence according to the methods disclosed allows the modification of the vertical profile of the bridge superstructure to be completed without overstressing any bridge members, and with predictable results.

30 Claims, 8 Drawing Sheets

| PANEL POINT NO. | 78 | 79 | 80 | 81 | 82 | 83 | 84 | 85 | 86 | 87 | 88 | 89 | 90 | 91 | 92 | 93 | 94 | 95 | 96 |
|---|---|---|---|---|---|---|---|---|---|---|---|---|---|---|---|---|---|---|---|
| TOTAL ADJUSTMENT | 11.3 | 11.3 | 11.2 | 11.2 | 11.1 | 11.0 | 10.9 | 10.8 | 10.7 | 10.5 | 10.4 | 10.2 | 10.0 | 9.8 | 9.5 | 9.3 | 9.0 | 8.7 | 8.5 |
| PASS 1 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 |
| JACKING FORCE | | | | | | | | | | | | | | | | | | | |
| PASS 2 | 8.0 | 8.0 | 8.0 | 8.0 | 8.0 | 8.0 | 8.0 | 8.0 | 8.0 | 8.0 | 8.0 | 8.0 | 8.0 | 8.0 | 8.0 | 8.0 | 8.0 | 8.0 | 8.0 |
| JACKING FORCE | | | | | | | | | | | | | | | | | | | |
| PASS 3 | 11.3 | 11.3 | 11.2 | 11.2 | 11.1 | 10.0 | 10.9 | 10.8 | 10.7 | 10.5 | 10.4 | 10.2 | 10.0 | 9.8 | 9.5 | 9.3 | 9.0 | 8.7 | 8.5 |
| JACKING FORCE | | | | | | | | | | | | | | | | | | | |

METHOD OF ADJUSTING THE VERTICAL PROFILE OF A CABLE SUPPORTED BRIDGE

TECHNICAL FIELD

The present invention is directed toward cable supported bridges, and more particularly toward a method of modifying the vertical profile of an existing cable supported bridge structure.

BACKGROUND ART

There are two primary types of cable supported bridge, the suspension bridge, and the cable stayed bridge. The superstructure of a suspension bridge consists of stabilizing trusses and the bridge roadbed. The superstructure is suspended from vertical hanger cables which extend upward to catenary cables. The catenary cables span the distance between adjacent suspension bridge towers and ride freely across the towers, transmitting load to anchorages at either end of the bridge. At the completion of the construction of a suspension bridge, dead load stresses in the superstructure members are very small, while dead load stresses in the hanger cables, catenary cables, anchorages and towers are quite large.

A typical cable stayed bridge also has one or more load bearing towers rising above the bridge superstructure. In contrast to the suspension bridge however, stay cables run from the tower diagonally to attachment points on the bridge superstructure.

Cable supported bridges are highly non-linear structures. Large displacements associated with construction, wind, seismic, dead and live loads are accommodated by the cables and other flexible bridge components and systems. Thus, any change in the load applied to the bridge superstructure can result in significant and unproportional change or displacement in the vertical profile of the bridge superstructure.

Most major cable supported bridges of the world span active shipping channels. Accordingly, maintenance of the clearance between the lowest point of the bridge superstructure and the water level is critical to assure unimpeded traffic under the bridge. Unfortunately, the flexibility inherent in a typical cable supported bridge structure allows significant downward deflection of the bridge superstructure if additional dead load is added. For example, the addition of a bike path or additional lanes of automobile traffic to an existing bridge superstructure can cause downward deflection of the superstructure which is substantial enough to obstruct the shipping lanes under the bridge.

Historically, when faced with this problem, bridge engineers have reduced the weight of the original bridge superstructure to offset the additional weight of the new load. For example, the weight of the addition of a bicycle path to an existing bridge superstructure might be offset by replacing the existing original concrete traffic deck with an orthotropic steel bridge deck. Upon completion of all phases of such a project, the overall weight of the bridge superstructure would remain unchanged, and the vertical profile of the bridge superstructure would remain substantially unchanged. The replacement of a concrete traffic deck with an orthotropic steal bridge deck requires periodic bridge lane closures over the course of a lengthy construction period. In addition, the capital cost of bridge deck replacement is very high.

The present invention is directed toward overcoming one or more of the problems discussed above.

SUMMARY OF THE INVENTION

The present invention is a method of modifying the vertical profile of a cable supported bridge. Alternatively, the invention is a cable supported bridge modified by the method disclosed herein. The modification of the vertical profile of a bridge can increase the clearance between the bottom of the bridge superstructure and the water or ground level below. In the alternative, the method of this invention can be used to preliminarily modify the vertical profile of a cable supported bridge allowing for subsequent increase in the dead load supported by the bridge without causing permanent alteration of the vertical profile of the bridge superstructure.

The method is applicable to a cable supported bridge having one or more towers supporting one or more cables attached to a bridge superstructure. The method is applicable but not limited to bridges built in either a cable stayed or suspension bridge configuration.

The method consists of sequentially adjusting the lower end of a series of supporting cables downward relative to the bridge superstructure or, in the case of a cable stayed bridge, adjusting the lower end of the series of cables away from the support tower, and sequentially adjusting an attachment structure associated with the lower end of each cable to maintain the distance each cable has been adjusted. The above actions effectively shorten each of a series of cables. The adjustments preferably proceed according to a pre-specified plan, known as an adjustment sequence. The effect upon the vertical profile of the bridge from the adjustment of any given cable is quite small; however, the net result of the adjustment of a series of cables is the modification of the vertical profile of the bridge superstructure. Additionally, after the vertical profile of the bridge has been modified, additional dead load can be added to the superstructure. By proper implementation of the method of this invention, the downward deflection resulting from the addition of new dead load to the bridge superstructure will offset the initial modification of the bridge's vertical profile resulting in clearance between the bottom of the bridge superstructure and the water line which is no less than that originally maintained.

DETAILED DESCRIPTION OF THE PREFERRED EMBODIMENT

Figure 1:
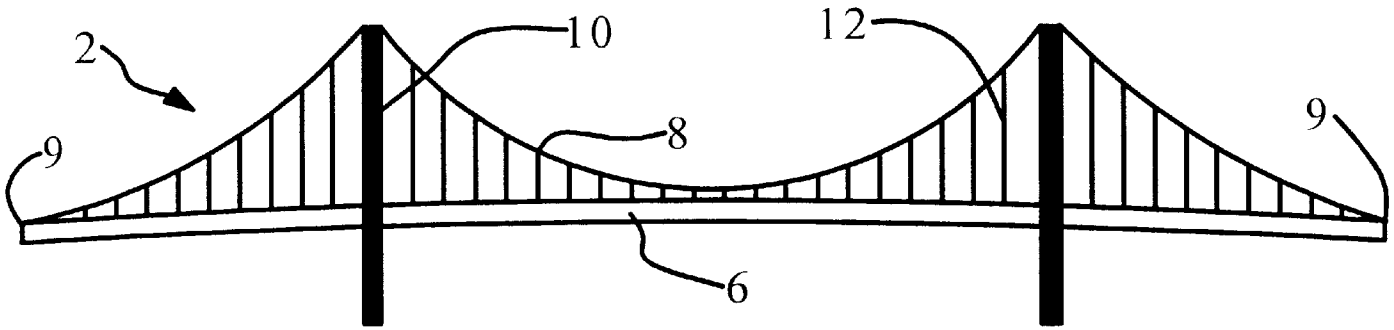
FIG. 1 is a schematic diagram of a suspension bridge.

A typical suspension bridge 2 is schematically represented in FIG. 1. The suspension bridge features multiple support towers 10. The distance between the towers is spanned by typically two parallel catenary cables 8 which run from anchorage points 9 across the upper end of each tower 10 and which describe a catenary arc between the towers. A series of hanger cables 12 are attached at their upper ends to the catenary cables 8. The hanger cables 12 hang downward and are attached at their lower ends to the bridge superstructure 6. Upon completion of a suspension bridge 2 the bridge superstructure 6 has a specific vertical profile which is a function of the stress and force relationship between and among the various elements of the suspension bridge 2.

Figure 2:
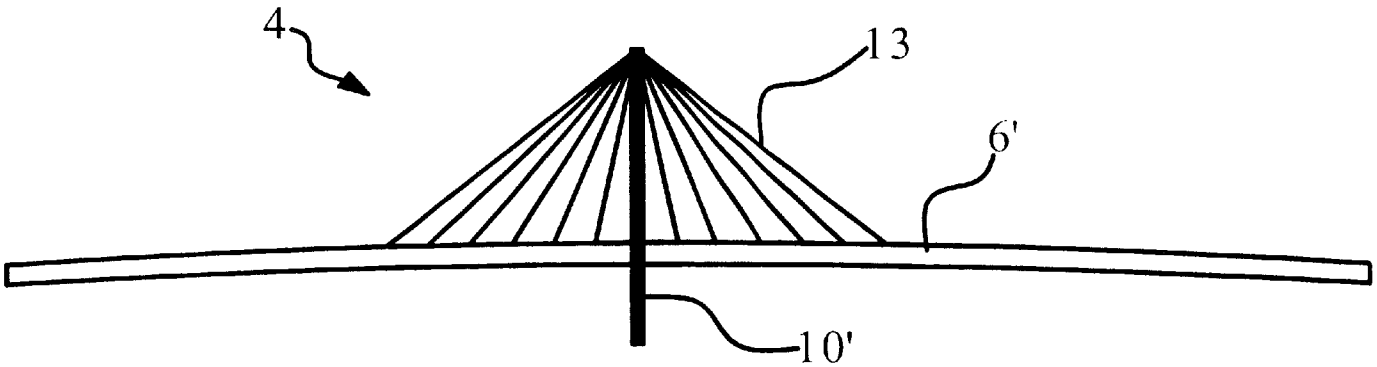
FIG. 2 is a schematic diagram of a cable stayed bridge.

A typical cable stayed bridge 4 is schematically represented in FIG. 2. One or more support towers 10' are attached to a fan of stay cables 13 extending diagonally from the support tower 10'. Other cable configurations are possible. The stay cables are attached at their lower ends to the bridge superstructure 6', and support the bridge superstructure 6'. The superstructure 6' of a cable stayed bridge 4 also has a specific vertical profile which is a function of the stress and force relationships between the components of the bridge.

The present invention is a method of modifying the vertical profile of the superstructure 6 of an existing cable supported bridge. The invention is applicable to a suspension bridge 2 or a cable stayed bridge 4. An alternative embodiment of the invention is a suspension 2 or cable stayed bridge 4 as modified by the following method. Modification of the vertical profile of a cable supported bridge is necessary in two instances. First, it may be necessary to modify the vertical profile of a bridge if it is necessary to increase the clearance between the bottom of the bridge superstructure 6 and the ground or water lying underneath. Second, an initial modification of the vertical profile of a cable supported bridge may be necessary if the addition of dead load to the bridge superstructure 6 is desired. An initial upward modification of the vertical profile of the bridge superstructure 6 according to the method of this invention can be followed by downward deflection as a result of the additional load with no net loss of clearance between the bottom of the bridge superstructure 6 and the ground or water lying below.

I. Physical Steps of Bridge Modification

Figure 6:
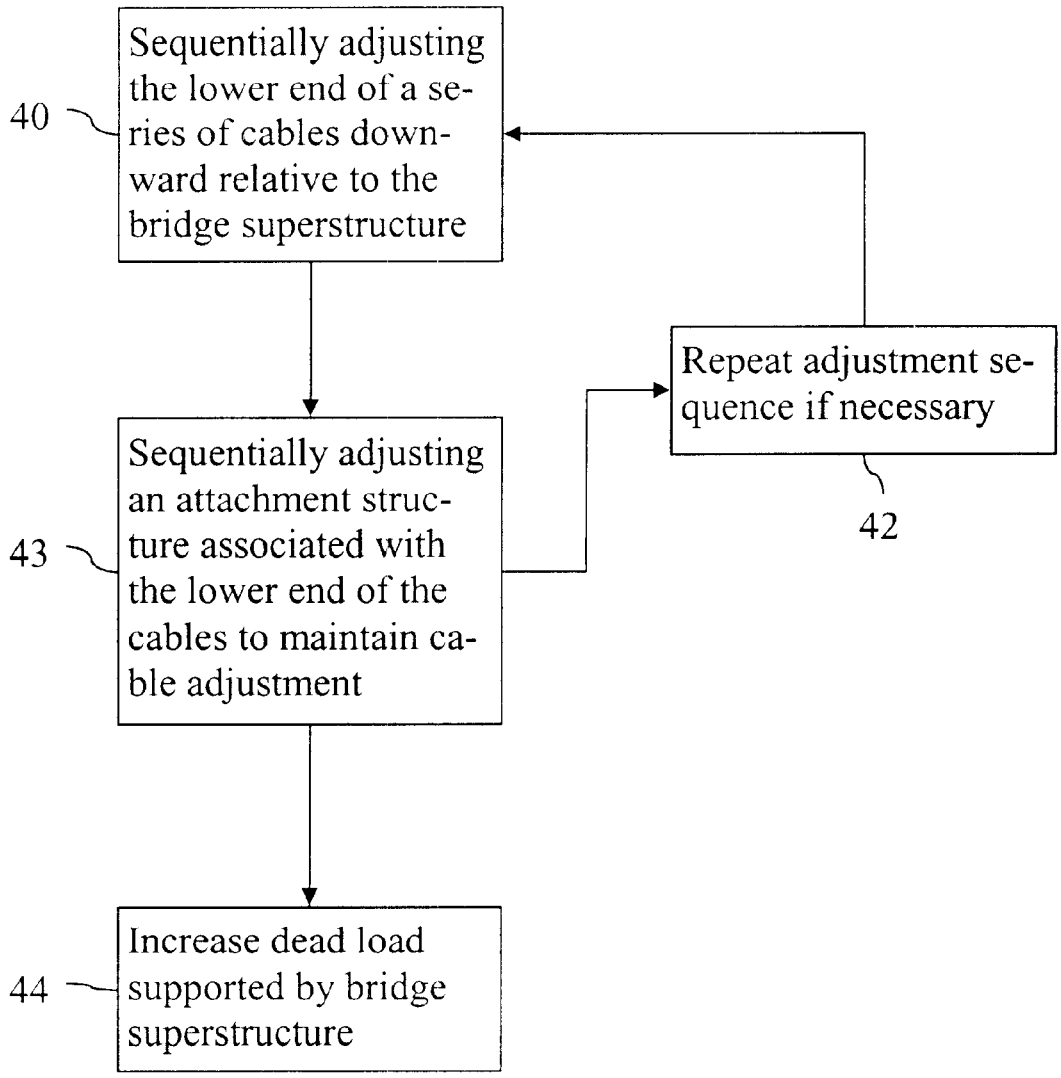
FIG. 6 is a schematic flow chart outlining the main components of the method for modifying the vertical profile of a cable supported bridge.

The physical steps of the method of modifying the vertical profile of the superstructure 6 of a cable supported bridge are represented in flow chart form in FIG. 6. The first step 40 of the physical modification is accomplished by sequentially adjusting the lower end of a series of cables attached to the bridge superstructure 6. The cables adjusted can either be the hanger cables 12 of a suspension bridge 2, or the stay cables 13 of a cable stayed bridge 14. In the case of a suspension bridge, the lower end of the cable being adjusted is moved downward a specific linear distance relative to the bridge superstructure 6. In the case of a cable stayed bridge 4, the lower end of the cable being adjusted is moved away from the support tower 10. The second step 43 of the physical modification consists of adjusting an attachment structure (see FIG. 3A, element 16 of FIG. 4A, element 22 for representative attachments structures) associated with the lower end of each cable 12 to maintain the linear distance the cable 12 has been adjusted relative to the bridge superstructure 6.

Figure 3A:
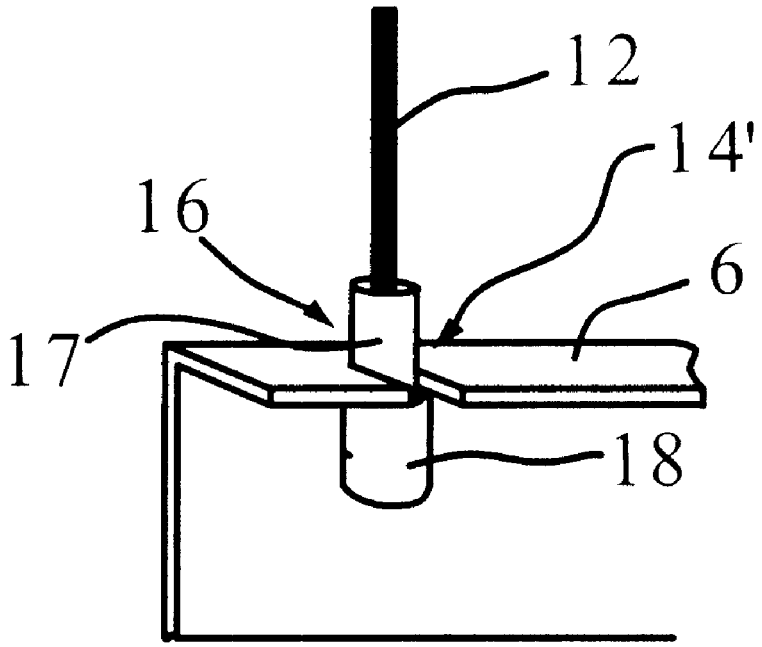
FIG. 3A is a perspective view of a button end cable termination and associated cable prior to adjustment.

FIG. 3A shows one type of cable attachment structure prior to any adjustments. The cable 12 is attached to a button end 16. The button end 16 has a narrower upper section 17 and a wider lower section 18. The button end 16 is captured in an opening 14 in the bridge superstructure 6 such that the tension in the cable 12 can not pull the lower end 18 of the button head 16 through the opening 14. Typically, the attachment point is near the upper chord of the superstructure 6. The opening 14 which captures the button head could be formed in the bridge superstructure 6 as is shown in FIG. 3A or it could be formed in a separate bracket affixed to the bridge superstructure 6. Downward forces on the bridge superstructure 6 are transmitted to the button end 16 and associated cable 12. Tension in the cable 12 applies a force upon the catenary cable 8 or tower 10 which is at the other end of the cable 12. Thus the superstructure 6 of the bridge is supported by the cables 12.

Figure 4A:
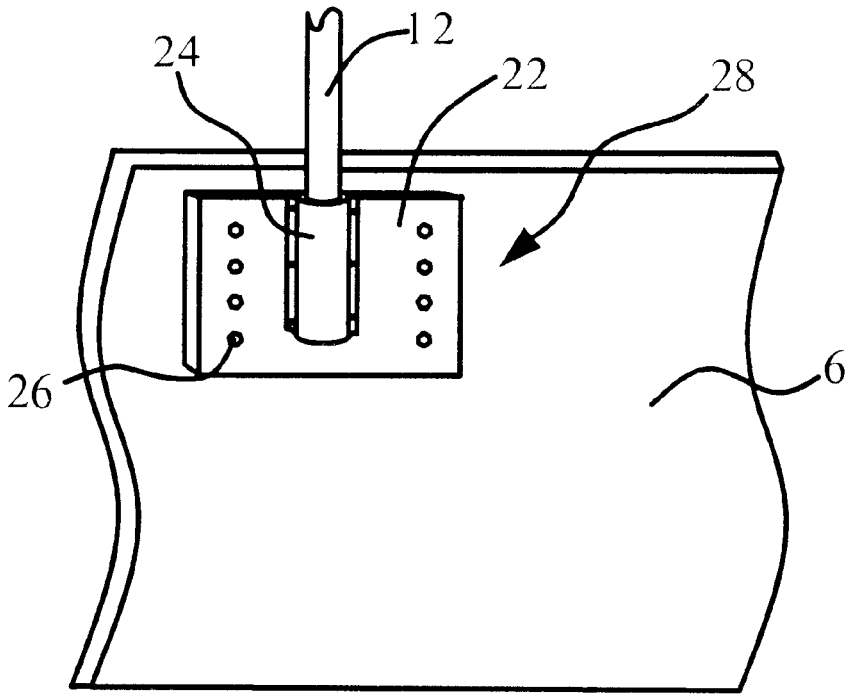
FIG. 4A is a perspective view of a clamp type cable termination and associated cable prior to adjustment.

A second representative type of cable attachment structure is shown in FIG. 4A, also depicting a pre-adjustment configuration. As shown in FIG. 4A, the cable 12 is permanently attached to a mounting plate 22 by a clamping socket 24. The mounting plate 22 is attached by bolts 26 to the bridge superstructure 6. Typically, the attachment point is near the upper chord of the superstructure 6. Other attachment structures than those depicted in FIGS. 3A and 4A are commonly available. All types of attachment structures can be divided into two families however. The first family consists of attachment structures such as that shown in FIG. 3A in which the cable 12 can move relative to the attachment structure. For example, the upper portion 17 of the button head 16 can slide downward through the opening 14 if enough force is applied to the lower end 18 of the button head 16. The second family of attachment structures allow no movement of the cable 12 relative to the attachment structure. The clamping socket 24 and mounting plate 22 structure is representative of this type of mounting structure. Differing means for adjusting the lower end of the cable 12 relative to the superstructure 6 are required for each type of attachment structure.

Figure 3B:
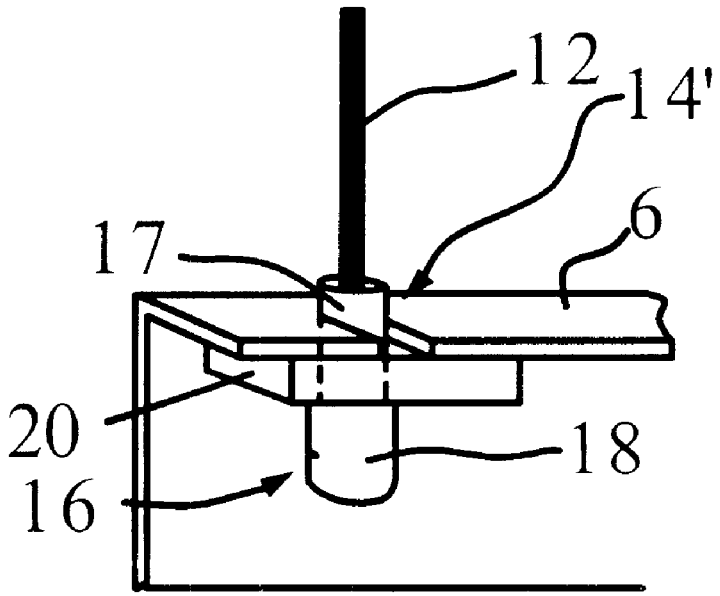
FIG. 3B is a perspective view of a button end cable termination and associated cable subsequent to adjustment.

FIG. 3B depicts the button end 16 attachment structure after an adjustment has been made. Adjustment is accomplished by applying a longitudinal force to the lower end 18 of the button head 16 sufficient to stretch the cable 12 or flex associated bridge members. Since the upper end of the button head 16 can slide through the opening 14, the lower end of the cable 12 can move relative to the superstructure 6. The force necessary to adjust the cable can be applied by a jacking mechanism, or other mechanical device. Application of a sufficient force to the lower end 18 of the button head 16 will move the lower end of the cable 12 a specified linear distance. The adjustment can be maintained by inserting a shim 20, which is sized according to the linear distance of the adjustment between the lower end 18 of the button head 16 and the opening 14. Other types of adjustments to different types of attachment mechanism are possible to maintain the linear distance the lower end of the cable has been moved. For example, a clamp which was loosened to allow the cable to move relative to an attachment structure could be tightened. Alternatively, the cable 12 can be terminated in a clevis which is secured in the adjusted position relative to the attachment structure by the insertion of a retaining pin through a hole located higher up on the clevis.

Figure 4B:
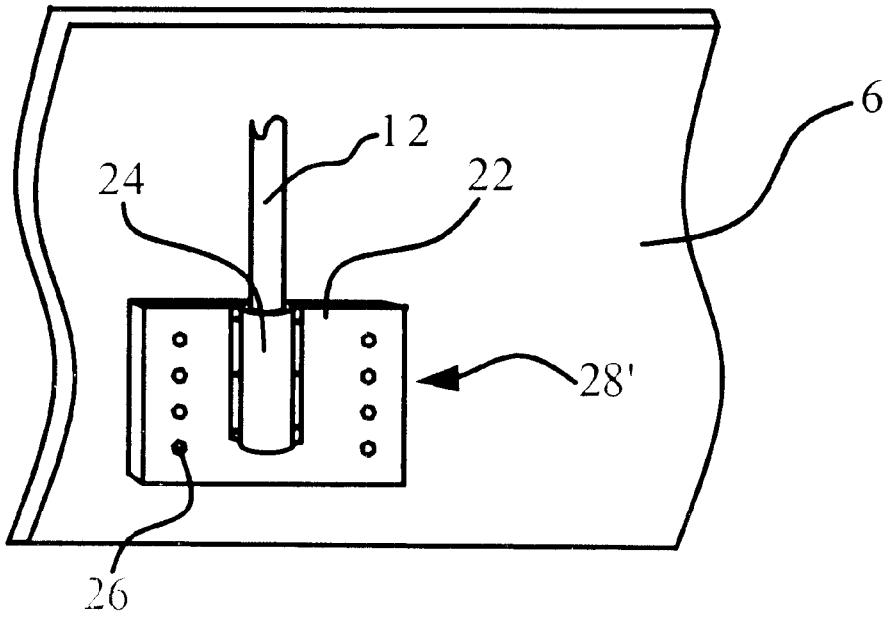
FIG. 4B is a perspective view of a clamp type cable termination and associated cable subsequent to adjustment.

If the cable 12 is permanently locked into the attachment structure as is represented in FIG. 4, it is necessary to move the entire attachment structure relative to the bridge superstructure 6 to maintain any adjustment. FIG. 4A depicts the mounting plate 22 bolted to the bridge superstructure 6 in position 28, near the top chord of the superstructure. FIG. 4B shows the mounting plate moved to position 28', away from the top chord and toward the centerline of the superstructure 6. The linear distance which the attachment structure has been moved corresponds to the linear length of the adjustment made to the end of the cable 12.

The adjustment of any single cable 12 as described above will result in a very small effect on the vertical profile of the superstructure 6 of a bridge. However, after all cables 12 in the appropriate series are adjusted, a substantial change in the vertical profile of the bridge can be accomplished. It may be necessary to repeat the adjustment step 42 of each cable 12 several times to achieve the final desired profile.

In certain instances, the vertical profile of the superstructure of the bridge is modified to allow an increase in the load supported by the bridge, without reducing the original clearance underneath the bridge. In such an instance, the final step in the physical modification of the bridge is the addition of increased load, step 44.

II. Preparation of an Adjustment Sequence

Figure 5:
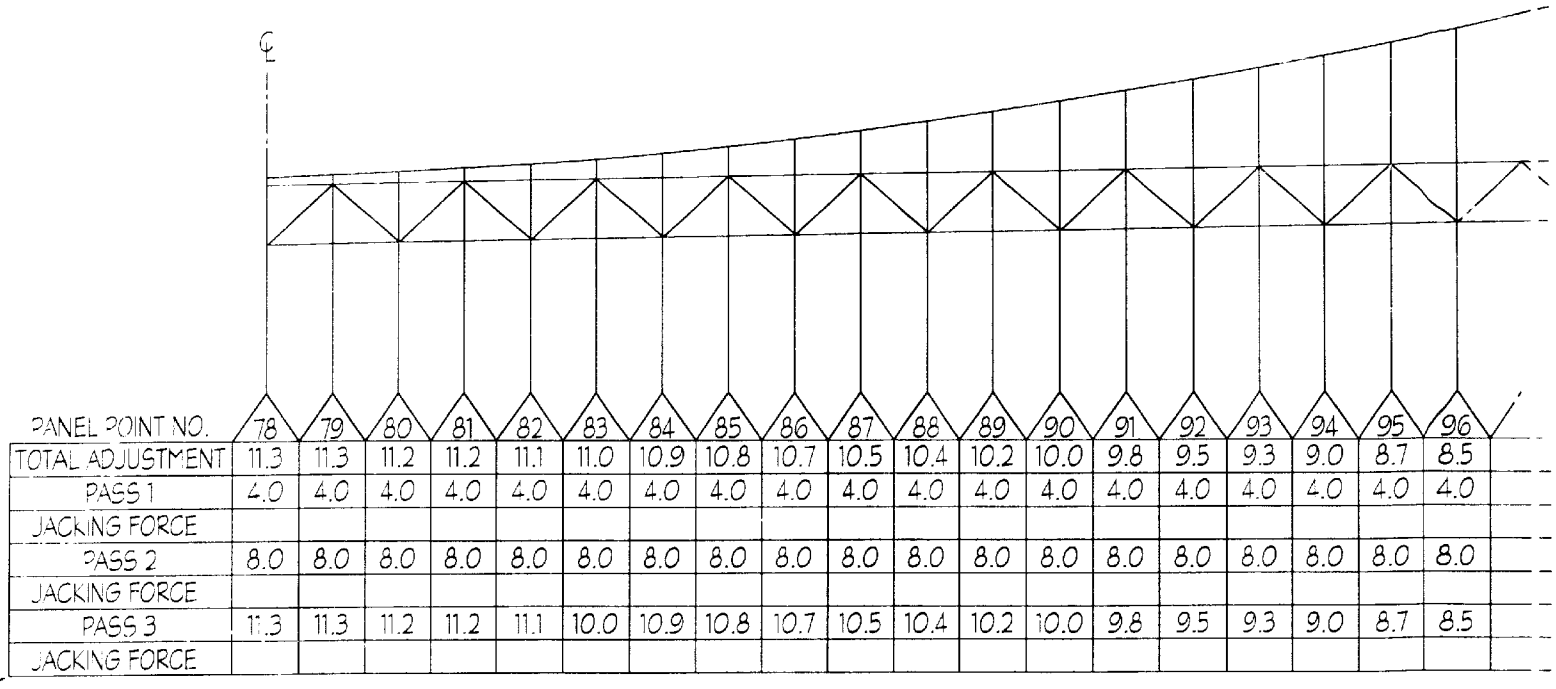
FIG. 5 is a representative adjustment sequence.
Figure 5:
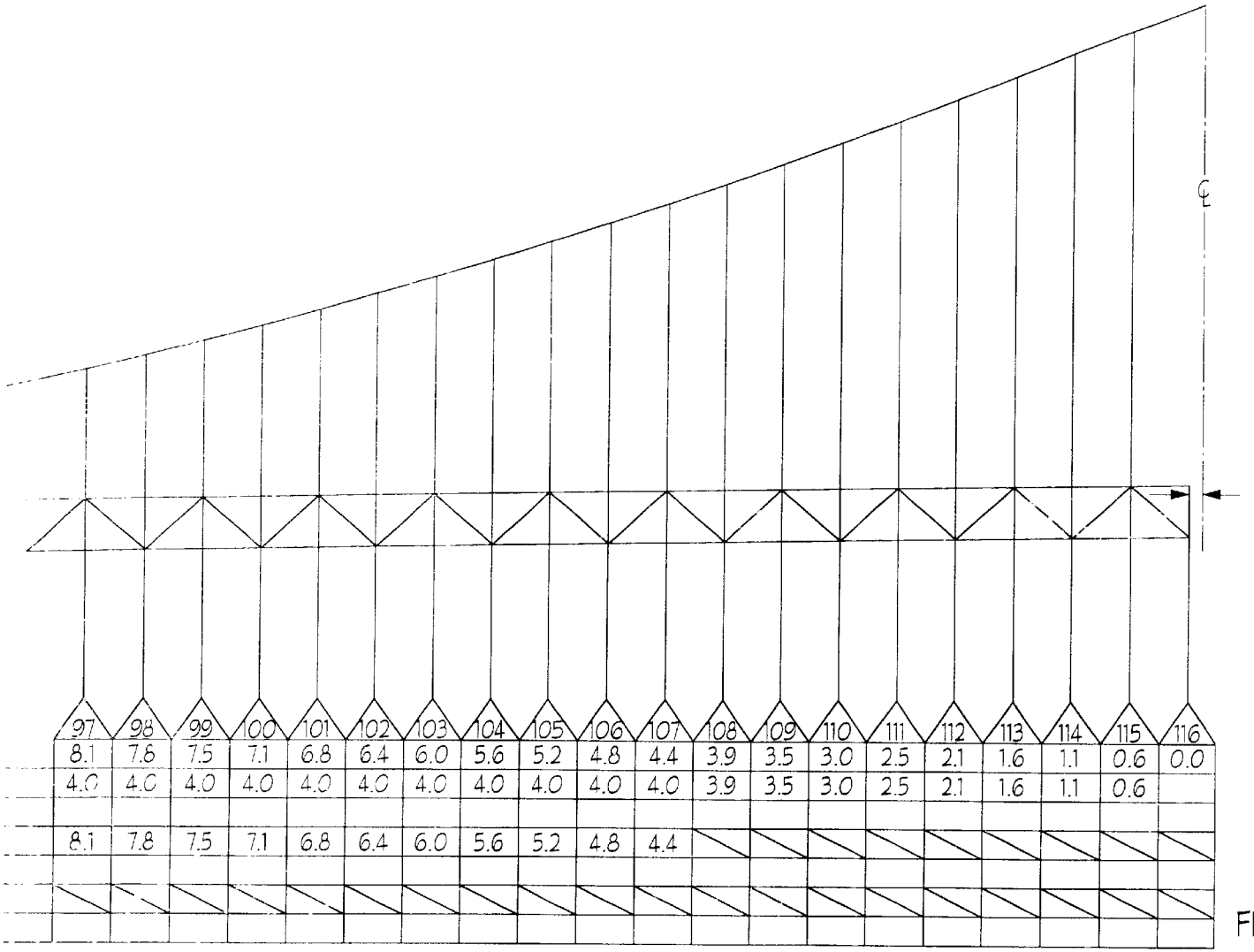

The extent and sequence of the adjustment of the lower end of each cable 12 is dependent upon the specific configuration of the bridge being modified and upon the desired superstructure profile. In a preferred embodiment of the invention, the cables 12 are adjusted in a specified sequential order and by a specified linear distance which is based upon an adjustment sequence 30. A representative adjustment sequence 30 is shown in FIG. 5.

An adjustment sequence 30 is necessary to achieve the desired change to the vertical profile of the bridge superstructure 6 without overstressing hanger 12 or stay cables 13, catenary cables 8, or other bridge components. The adjustment sequence also facilitates the prediction of the final vertical profile of the bridge superstructure 6 prior to the commencement of physical adjustments to the bridge structures.

Figure 7:
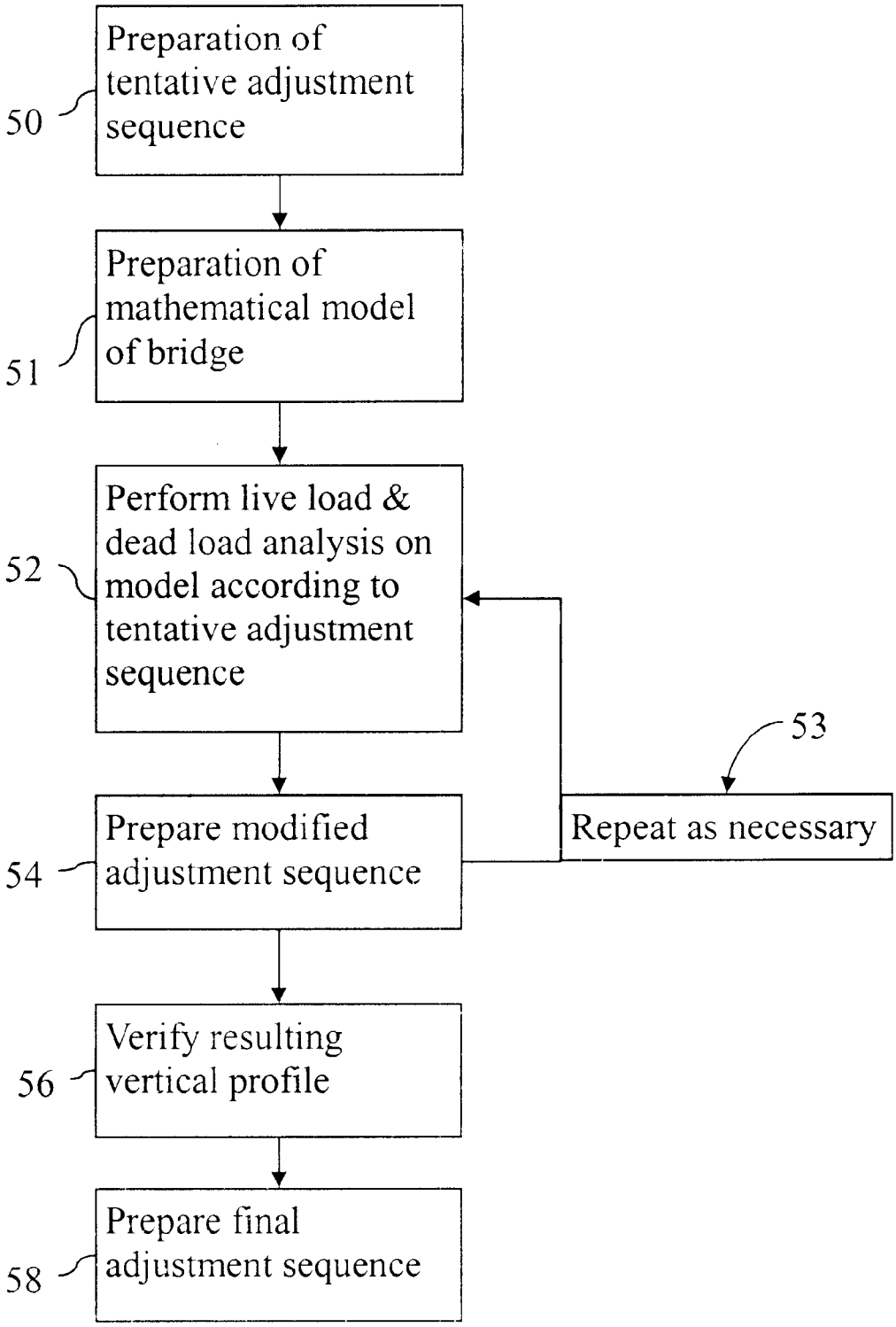
FIG. 7 is a schematic flow chart outlining the main steps in the preparation of an adjustment sequence.
Figure 8:
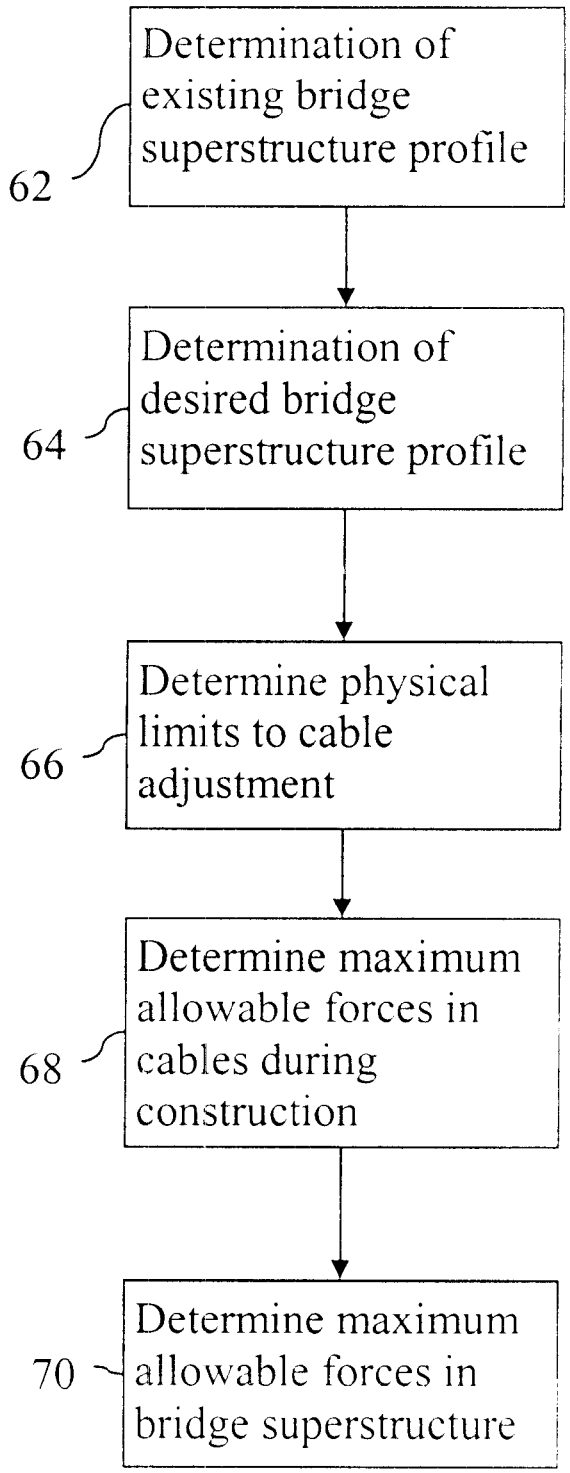
FIG. 8 is a schematic flow chart outlining the preliminary analysis of a cable supported bridge.

An adjustment sequence can be determined by the method illustrated in FIG. 7. The first step in the preparation of an adjustment sequence 30 is a thorough analysis of the bridge. The analysis must take into account dead loads, live loads, and the proposed sequence and linear distance of the cable adjustments. As shown in FIG. 8, preliminary analysis of the bridge consists of the following steps:

A. Determination of the existing bridge superstructure profile 62.

B. Determination of the desired bridge superstructure profile 64.

C. Determination of the limits of the hanger cable adjustments such as physical limits imposed by the cable connections or the proximity of the main suspension cables to the deck superstructure 66.

D. Determination of the maximum allowable forces in the cables during construction 68. These temporary forces are generally higher than service loads, and will be governed by the design codes or design criteria in use by the entity having jurisdiction over the bridge.

E. Determination of the maximum allowable forces in the bridge superstructure members during construction 70.

Returning to FIG. 7, following the initial analysis of the bridge, at step 50 the bridge engineer will prepare a tentative adjustment sequence based upon the above preliminary calculations, expected construction methods and the engineer's intuition. It is not necessary that the tentative adjustment sequence of step 50 be an ultimately workable plan. It is necessary that the engineer have a starting point for analysis. The tentative adjustment sequence of step 50 will include the maximum linear distance change of cable length anticipated at any given stage. The tentative adjustment sequence of step 50 will also specify the order in which adjustments are to be made to specific cables 12. The tentative adjustment sequence of step 50 may specify, for example, sequentially adjusting each cable 12 from one end of a span to the other up to the maximum adjustment allowable for a single stage, then starting over again at one end for another pass. An alternative tentative adjustment sequence of step 50 could require adjustment of a few cables 12 in sequence to gain the full adjustment desired, then proceeding to fully adjust another group.

In addition to the preparation of a tentative adjustment sequence of step 50, the engineer may prepare a non-linear mathematical model of the bridge at step 51, including mathematical representations of all bridge members such as the deck superstructure 6, (consisting of floor beams, stiffening elements and roadbed), hanger cables 12, catenary cables 8, towers 10, and other elements that may affect the structural load path. This model must include large deflection effects, and must include a means of modeling the effect of a change in the length of individual cables 12. Computer software with this capability is readily available. Software packages such as ADINA available from Adina R&D, Inc. Watertown, Mass. or SAP2000 available from Computers and Structures, Inc., Berkeley, Calif., which feature analysis using the Finite Element Method are particularly well suited for analysis of large dynamic structures such as cable supported bridges.

The mathematical model of the bridge must be capable of deforming in response to applied loads. The model must also be capable of being revised to conform to the new geometry after deformation while the external loads and internal forces are maintained.

The next step 52 in the preparation of a final adjustment sequence 30 is the analysis of the tentative adjustment sequence with the model of the bridge. The testing of the tentative adjustment sequence with the model of the bridge should proceed according to the steps as set forth in the tentative adjustment sequence developed in step 50. The first adjustment to a cable 12 is imposed upon the model just as the first adjustment would be imposed upon the real structure. Following the first adjustment, live and dead load analysis of the model which simulates the effect of traffic on the bridge, wind, seismic effects or other stresses for the time frame between the first and second adjustment can be performed. Then, the second adjustment indicated by the tentative adjustment sequence is imposed upon the model and the dead and live load analysis is redone. Similarly each adjustment required by the tentative adjustment sequence is imposed upon the model. The results of the analysis of the tentative adjustment sequence 50 by use of the model are internal member forces in each of the bridges structural elements, for each step in the modification process. At each step, each bridge member is checked to see that the member demands do not exceed the capacities determined in the preliminary analysis of the bridge. The member demands are a result of both the adjustments made to the cables 12 as dictated by the tentative adjustment sequence, and the various live loads.

In the likely event that some member or members are overstressed at some point, the tentative adjustment sequence of step 50 is modified in step 54. Specific modifications to the tentative adjustment sequence 50 can be developed based upon the location, type and magnitude of the overstress. This process of adjustment 54 and analysis 52 is repeated as necessary until an entire tentative modified adjustment sequence of step 54 can be completed upon the model without overstressing any bridge member. At this point it is possible to verify the vertical profile of the bridge superstructure 6 resulting from the application of the modified adjustment sequence of step 54 to the model of the bridge at step 56. If the resulting vertical profile of the bridge superstructure 6 matches the design goals, the modified tentative adjustment sequence determined at step 54 becomes a final adjustment sequence 30. If the resulting vertical profile is incorrect, further revisions are made to the modified tentative adjustment sequence at step 54 and the above analysis process is repeated until a satisfactory vertical profile is modeled.

Ultimately, the final adjustment sequence 30 is implemented on the actual bridge structure. As the sequence of adjustments dictated by the adjustment sequence are implemented, stresses on various bridge members can be monitored. In particular, the deformations imposed by the cable 12 adjustments are likely to be monitored during construction.

What is claimed is:

1. A method of modifying a vertical profile of a cable supported bridge having one or more towers supporting a plurality of cables attached to a bridge superstructure, each of the plurality of cables having a lower attachment point, an upper attachment point, and a distance between the lower attachment point and the upper attachment point, the method comprising:

a. sequentially adjusting, by applying a force, a position of the lower attachment point of each cable in a series of the plurality of cables by a specified linear distance per cable, such that the position of the lower attachment point is modified relative to the bridge superstructure; and b. sequentially adjusting an attachment structure associated with the lower attachment point of each adjusted cable to maintain, when the force is removed, the linear distance the position of the lower attachment point of the cable has been modified relative to the bridge superstructure, whereby the distance between the upper attachment point and the lower attachment point remains substantially unchanged when the force is removed from each cable in the series of the plurality of cables.

2. The method of claim 1 wherein in step a. the sequence of cable adjustment and the linear distance each cable is adjusted proceeds according to an adjustment sequence.

3. The method of claim 2 wherein the adjustment sequence comprises sequentially adjusting each hanger cable from one end of a span to a second end of the span.

4. The method of claim 2 wherein the adjustment sequence is repeated in multiple passes to obtain a desired adjustment greater than that obtainable in a single pass through the adjustment sequence.

5. The method of claim 1 wherein stresses in structural members of the cable supported bridge are monitored during the physical implementation of the adjustment sequence.

6. The method of claim 1 wherein in step b. the attachment structure is modified by adding a shim between a terminal portion of the cable and the attachment structure.

7. The method of claim 1 wherein in step a. the cable being adjusted is pulled downward toward the centerline of the bridge superstructure by a jacking device.

8. A method of modifying a vertical profile of a cable supported bridge having one or more towers supporting a plurality of cables attached to a bridge superstructure, comprising:

a. sequentially adjusting the lower end of each cable in a series of the plurality of cables by a specified linear distance per cable, relative to the bridge superstructure wherein the sequence of cable adjustment and the linear distance each cable is adjusted proceeds according to an adjustment sequence comprising:

a1. preparing a tentative adjustment sequence;

a2. preparing a non-linear mathematical model of the bridge;

a3. performing live and dead load analysis of the non-linear mathematical model of the bridge at various stages in the tentative adjustment sequence;

a4. determining if resulting deformations cause member forces to exceed allowable forces; and b. sequentially adjusting an attachment structure associated with the lower end of each adjusted cable to maintain the linear distance the lower end of the cable has been adjusted relative to the bridge superstructure.

9. The method of claim 8 further comprising the following, if the analysis of claim 8, step a3. results in a determination that deformation has caused member forces to exceed allowable forces;

a5. preparing a modified tentative adjustment sequence based upon the results of the live and dead load analysis of claim 3, step a3.; and a6. performing live and dead load analysis of the non-linear mathematical model of the bridge at various stages in the modified tentative adjustment sequence.

10. The method of claim 8 further comprising verification of the bridge profile resulting from application of the tentative adjustment sequence to the mathematical model of the bridge.

11. The method of claim 9 further comprising verification of the bridge profile resulting from application of the modified tentative adjustment sequence to the mathematical model of the bridge.

12. The method of claim 8 wherein in step a2. the non-linear mathematical model of the bridge comprises:

a2a. a mathematical representation of structural elements that affect the structural load path;

a2b. a mathematical representation of large deflection effects; and a2c. an active representation of the effect of a change in the length of individual cables.

13. The method of claim 8 wherein the adjustment sequence comprises sequentially adjusting each hanger cable from one end of a span to a second end of the span.

14. The method of claim 8 wherein the adjustment sequence is repeated in multiple passes to obtain a desired adjustment greater than that obtainable in a single pass through the adjustment sequence.

15. The method of claim 8 wherein stresses in structural members of the cable supported bridge are monitored during the physical implementation of the adjustment sequence.

16. The method of claim 8 wherein in step b. the attachment structure is modified by adding a shim between a terminal portion of the cable and the attachment structure.

17. The method of claim 8 wherein in step a. the cable being adjusted is pulled downward toward the centerline of the bridge superstructure by a jacking device.

18. A method of increasing a load supported by a cable supported bridge having one or more towers supporting a plurality of cables attached to a bridge superstructure, without permanently modifying a vertical profile of the superstructure of the bridge comprising:

a. temporarily modifying the vertical profile of the superstructure of the bridge by:

a1. sequentially adjusting the lower end of each cable in a series of the plurality of cables by a specified linear distance per cable, relative to the bridge superstructure;

a2. sequentially adjusting an attachment structure associated with the lower end of each adjusted cable to maintain the linear distance the lower end of the cable has been adjusted relative to the bridge superstructure; and b. returning the bridge superstructure to the original vertical profile by increasing the load supported by the bridge.

19. The method of claim 18 wherein in step a1. the sequence of cable adjustment and the linear distance each cable is adjusted proceeds according to an adjustment sequence.

20. The method of claim 19 wherein the preparation of the adjustment sequence comprises:

a1a. preparing a tentative adjustment sequence;

a1b. preparing a non-linear mathematical model of the bridge;

a1c. performing live and dead load analysis of the non-linear mathematical model of the bridge at various stages in the tentative adjustment sequence; and a1d. determining if resulting deformations cause member forces to exceed allowable forces.

21. The method of claim 19 further comprising the following if the analysis of claim 20, step a1c. results in a determination that deformation has caused member forces to exceed allowable forces;

a1e. preparing a modified tentative adjustment sequence based upon the results of the live and dead load analysis of claim 20, step a1c.; and a1f. performing live and dead load analysis of the non-linear mathematical model of the bridge at various stages in the modified tentative adjustment sequence.

22. The method of claim 20 further comprising verification of the bridge profile resulting from application of the tentative adjustment sequence to the mathematical model of the bridge.

23. The method of claim 21 further comprising verification of the bridge profile resulting from application of the modified tentative adjustment sequence to the mathematical model of the bridge.

24. The method of claim 20 wherein in step a1b. the non-linear mathematical model of the bridge comprises:

a1b1. determining a mathematical representation of structural elements that affect the structural load path;

a1b2. determining a mathematical representation of large deflection effects;

a1b3. determining an active representation of the effect of a change in the length of individual cables.

25. The method of claim 19 wherein the adjustment sequence comprises sequentially adjusting each hanger cable from one end of a span to a second end of the span.

26. The method of claim 19 wherein the adjustment sequence is repeated in multiple passes to obtain a desired adjustment greater than that obtainable in a single pass through the adjustment sequence.

27. The method of claim 18 wherein stresses in structural members of the cable supported bridge are monitored during the physical implementation of the adjustment sequence.

28. The method of claim 18 wherein in step a2. the attachment structure is modified by adding a shim between a terminal portion of the cable and the attachment structure.

29. The method of claim 18 wherein in step a1. the cable being adjusted is pulled downward toward the centerline of the bridge superstructure by a jacking device.

30. A cable supported bridge having a preexisting vertical profile and having one or more towers supporting a plurality of cables attached to a bridge superstructure each of the plurality of cables having a lower attachment point, the cable supported bridge modified by a process comprising:

a. sequentially adjusting a position of the lower eattachment point of each cable in a series of the plurality of cables, by a specified linear distance per cable such that the position of the lower attachment point is modified relative to the bridge superstructure; and b. sequentially adjusting an attachment structure associated with the lower end attachment point of each adjusted cable to maintain the linear distance the lower attachment point of the cable has been adjusted relative to the bridge superstructure.

* * * * *